US011046400B2

(12) United States Patent
Godoy et al.

(10) Patent No.: US 11,046,400 B2
(45) Date of Patent: Jun. 29, 2021

(54) BALANCING JACKET WITH VARIABLE TRIM FOR UNDERWATER DIVING

(71) Applicant: Cressi-Sub S.p.A., Genoa (IT)

(72) Inventors: Carlos Alberto Godoy, Genoa (IT); Pietro Micillo, Genoa (IT)

(73) Assignee: Cressi-Sub S.P.A., Genoa (IT)

( * ) Notice: Subject to any disclaimer, the term of this patent is extended or adjusted under 35 U.S.C. 154(b) by 0 days.

(21) Appl. No.: 17/098,598

(22) Filed: Nov. 16, 2020

(65) Prior Publication Data

US 2021/0147048 A1 May 20, 2021

(30) Foreign Application Priority Data

Nov. 20, 2019 (IT) ..... 102019000021744

(51) Int. Cl.
*B63C 11/08* (2006.01)

(52) U.S. Cl.
CPC ..... *B63C 11/08* (2013.01); *B63C 2011/085* (2013.01)

(58) Field of Classification Search
CPC ... B63C 11/02; B63C 11/08; B63C 2011/085; A41B 2300/33; A41D 2300/33; A41F 15/002; A41F 9/002; Y10T 24/4736; Y10T 24/4745; Y10T 24/45796
USPC ..... 2/2.15; 405/185–187; 441/106, 108, 441/114, 115, 117; 224/637, 648, 649, 224/662, 665, 671, 672, 675
See application file for complete search history.

(56) References Cited

U.S. PATENT DOCUMENTS 4,990,115 A * 2/1991 Vorhauer ..... B63C 11/08 441/108
5,742,988 A * 4/1998 Swetish ..... B63C 11/02 24/667
6,402,429 B1 * 6/2002 James ..... B63C 11/08 405/186
2004/0031080 A1 * 2/2004 Feng ..... B63C 11/08 2/2.15

* cited by examiner

*Primary Examiner* — Sunil Singh
(74) *Attorney, Agent, or Firm* — Blank Rome LLP

(57) ABSTRACT

A buoyancy control jacket (1) for scuba diving that includes at least one air chamber (2) with a variable volume delimited by an outer wall (2*a*) and an inner wall (2*b*), an abdominal closing strap, and a removable association device between the inner wall (2*b*) and the abdominal strap, the removable association device including first and second connectors respectively attached to the inner wall (2*b*) and to the strap, a retainer that retains the second connector relative to the first connector along an axis that is substantially orthogonal to the strap, and a means of rotation about said axis of the second connector relative to the first connector.

13 Claims, 6 Drawing Sheets

BALANCING JACKET WITH VARIABLE TRIM FOR UNDERWATER DIVING

RELATED APPLICATIONS

This application claims benefit of priority of Italy Application No. 102019000021744, filed Nov. 20, 2019. The above-identified related application is incorporated by reference.

FIELD OF USE

The present invention relates to a buoyancy control jacket for scuba diving with a replaceable abdominal closing strap.

BACKGROUND OF THE INVENTION

Buoyancy control jackets (or buoyancy control devices—BCDs) have been known and present on the market for some time as individual accessories for scuba diving used to increase the diver's ability to control the level of depth to be maintained or varied during a dive.

A BCD comprises an expandable bladder, generally made of synthetic materials, worn like a jacket into which air coming from the cylinder is injected, and whose volume is regulated by inflation and deflation valves directly controlled by the diver: the increase or decrease in volume has a direct effect on hydrostatic thrust and therefore helps the diver to maintain or reach the hydrostatic balance required and desired at the various diving depths.

In the forms used, the BCD also has, on the rear dorsal part thereof, systems for securing the compressed air cylinder, as well as other elements for securing other accessories used during diving.

Good wearability of the BCD for the diver and the adherence thereof to the body is thus of extreme importance, both during the preparatory phases prior to the dive and, even more importantly, during the dive itself.

The BCD is worn by the diver like a backpack/vest, with two adjustable shoulder straps and a quick-coupling abdominal closing strap, normally integrated with a superimposable Velcro strap: the importance of the optimal maintenance conditions and reliability that such elements of the garment must be able to guarantee and maintain throughout the useful life of the BCD, in order to ensure the total safety of the diver during the dive, is thus clearly evident.

The abdominal closing strap is clearly subject to the most wear, as it undergoes coupling and release operations by the diver at every dive, and often various adjustments in the event that the BCD is subsequently used by different divers.

These straps are traditionally replaceable, but are fixed to rigid or soft back supports positioned in the central part of the BCD with coupling systems that require more time for assembly/disassembly and which cannot rotate in order to better adapt to the different builds of divers.

A type of jacket having a harness fitted with interchangeable accessories, including two abdominal closing half-straps and two shoulder straps, also exists in the market.

The harness in this case also supports the expandable pneumatic bladder, configured as a structurally independent and separate element that can be coupled to and released from the harness.

In this case, it is thus possible to personalise the jacket by replacing only the shoulder straps and/or the abdominal half-straps according to the diver's size, but only at the expense of a greater complexity of the product.

SUMMARY OF THE INVENTION

The technical task of the present invention, therefore, is to provide a buoyancy control jacket for scuba diving that enables the aforesaid technical drawbacks of the prior art to be overcome.

Within the scope of this technical task, one object of the invention is to provide a buoyancy control jacket for scuba diving which is versatilely adaptable to the diver's size and at the same time simplified in its construction but extremely robust.

The technical task, as well as these and other objects, are achieved according to the present invention by providing a buoyancy control jacket for scuba diving comprising at least one air chamber with a variable volume delimited by an outer wall and an inner wall, an abdominal closing strap, and a removable association device between said inner wall and said abdominal strap, characterised in that said removable association device comprises first and second connection means respectively attached to said inner wall and to said strap, a retaining means for retaining said second connection means relative to said first connection means along an axis that is substantially orthogonal to said strap, and a means of rotation about said axis of said second connection means relative to said first connection means.

In one embodiment of the invention, said abdominal closing strap comprises two half-straps having first ends that are reciprocally engageable in a disengageable manner, and second ends having said second connection means.

In one embodiment of the invention, said first and second connection means comprise at least one pin and a corresponding engagement terminal.

In one embodiment of the invention said retaining means comprises, on said engagement terminal, a sliding perimeter engagement groove for a head of said pin and an elastic tab with a free beaklike end for retaining said head of said pin in said groove.

In one embodiment of the invention, said rotation means comprises a cylindrical perimeter surface of the head of the pin having diametrically opposed cylindrical generatrix of contact with the groove.

In one embodiment of the invention, a reinforcement means is provided for reinforcing said inner wall for the distribution of forces transmitted by said second connection means to said first connection means.

In a preferred embodiment of the invention said association device is configured for a quick coupling, particularly a snap coupling.

Advantageously, therefore, thanks to the removable association device, it is possible to eliminate the harness of a known jacket: in particular, the shoulder straps as well as the support for positioning the compressed air cylinder can be secured to the air chamber.

The replaceability of the abdominal strap allows the same air chamber to be maintained for divers of all sizes.

The articulated fastening of the abdominal strap to the air chamber improves the wearability of the jacket with variations in the size of the diver.

The reinforcement means, by opposing the bending moments transmitted during use by the abdominal strap, contributes to preserving the structural integrity of the air chamber.

The rotatable connection between the first and second connection means, by freeing the rotation of the abdominal strap, limits or prevents the transmission of torsional moments to the air chamber, once again contributing to preserving the structural integrity thereof.

In one embodiment, the abdominal strap comprises at least one elastic zone to further improve the adjustment according to the size of the diver.

Other features of the present invention are also defined in the claims hereinbelow.

BRIEF DESCRIPTION OF THE DRAWINGS

Additional features and advantages of the invention will become more apparent from the description of a preferred but non-exclusive embodiment of the buoyancy control jacket for scuba diving according to the invention, illustrated by way of non-limiting example in the appended drawings, wherein.

DETAILED DESCRIPTION OF THE ILLUSTRATED EMBODIMENTS

With reference to the aforementioned figures, they show a buoyancy control jacket denoted in its entirety by the reference number 1.

Figure 4:
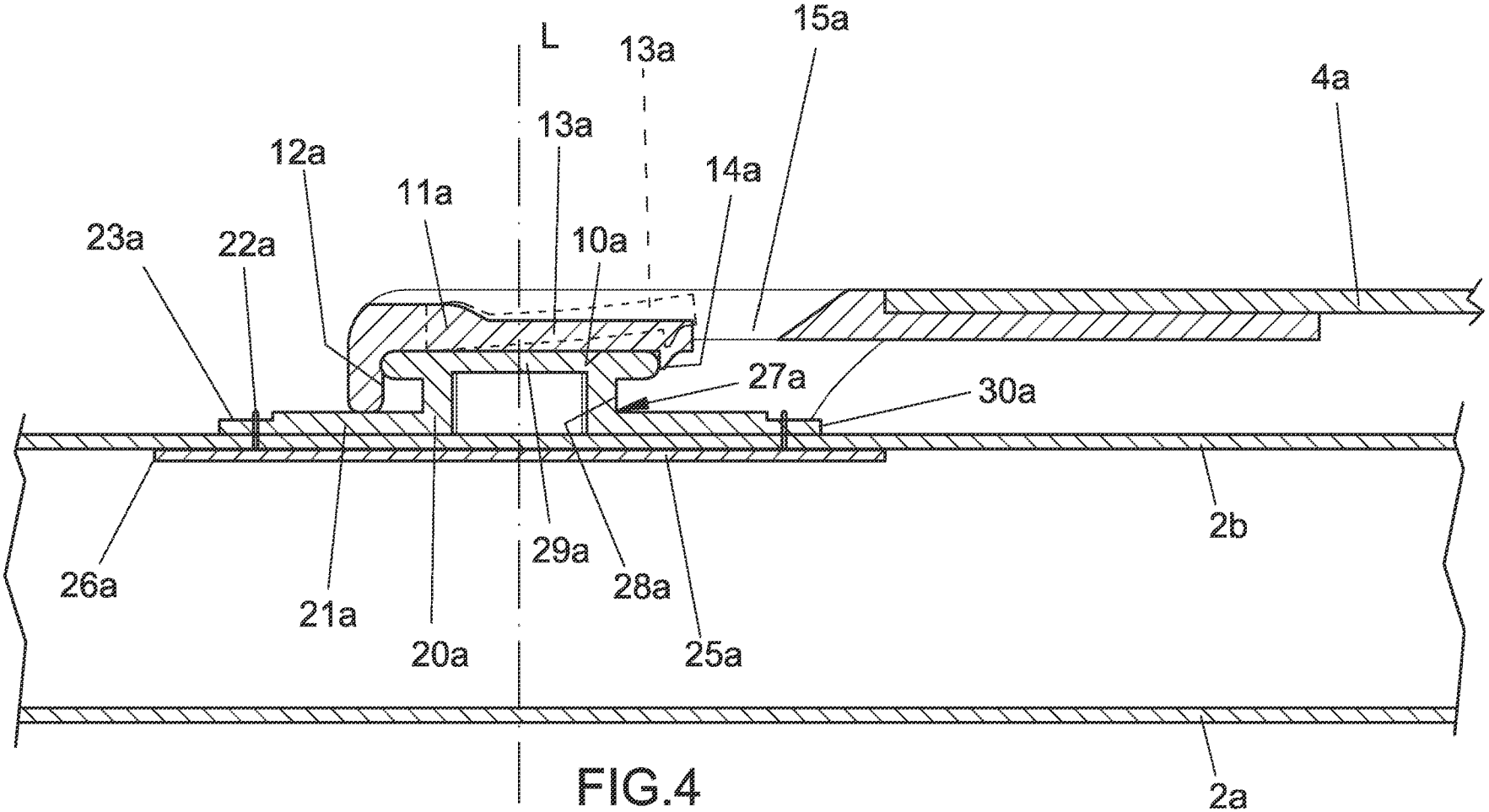
FIG. 4 shows a detailed section AA of FIG. 3 with the half-strap coupled.
Figure 5:
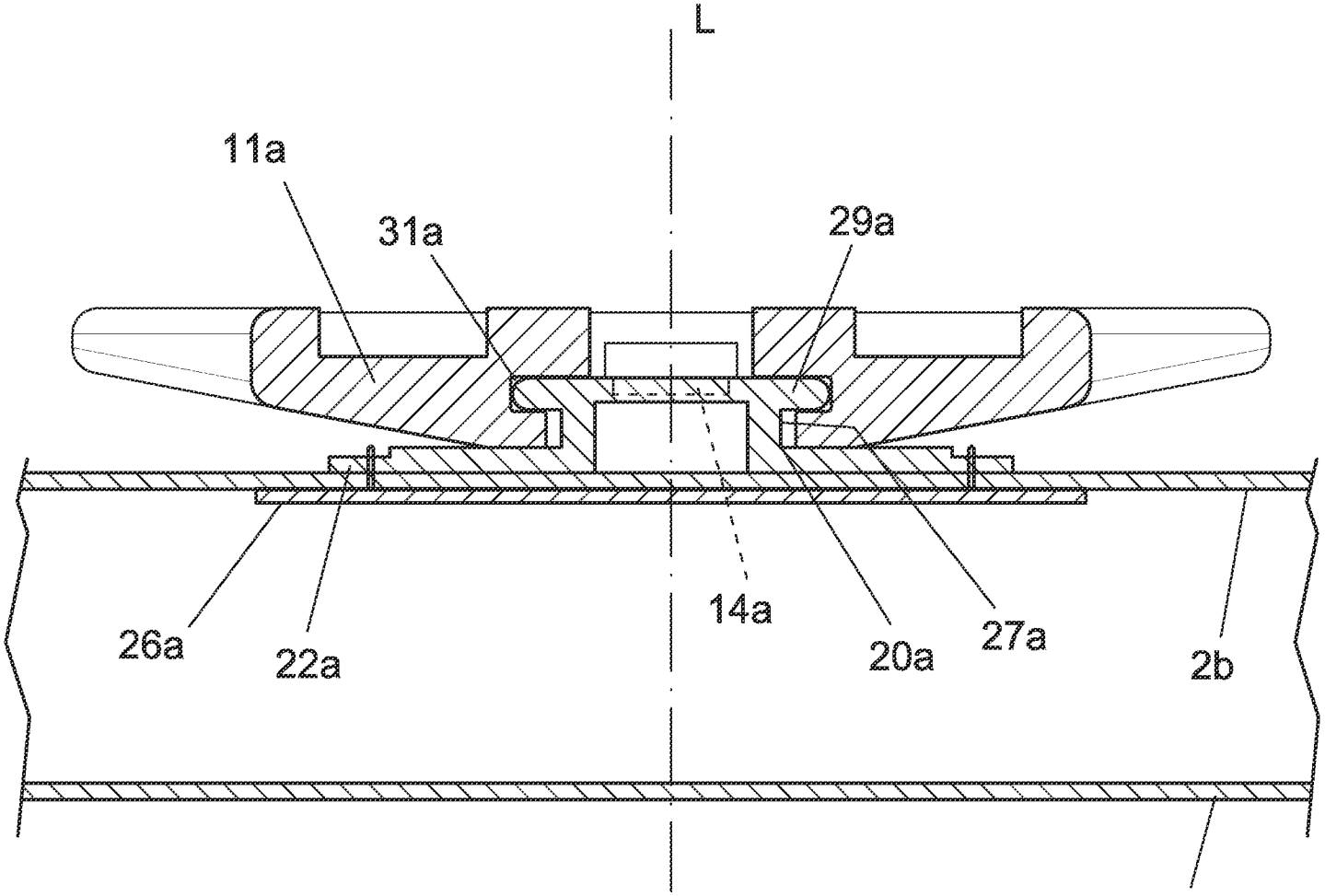
FIG. 5 shows a detailed section BB of FIG. 3 with the half-strap coupled
Figure 6:
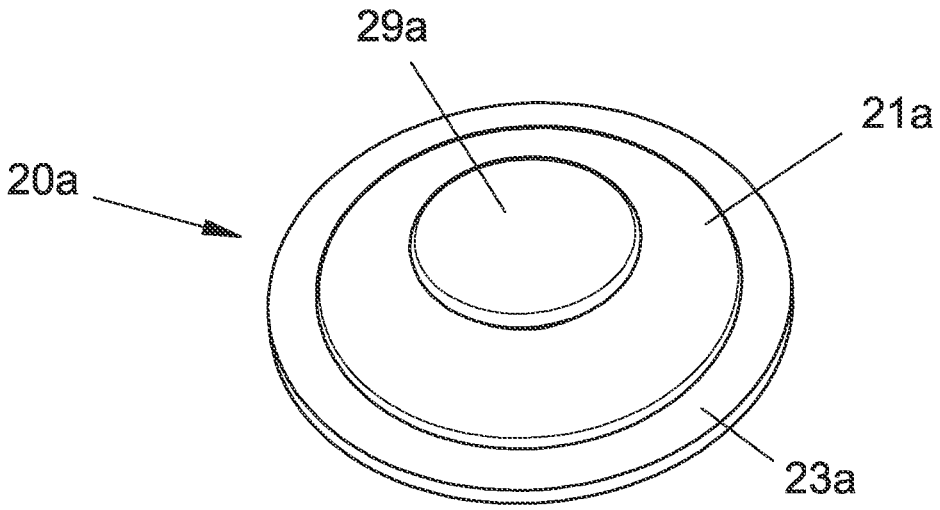
FIG. 6 shows a perspective view of the face of the first connection means intended to come into contact with the second connection means.
Figure 7:
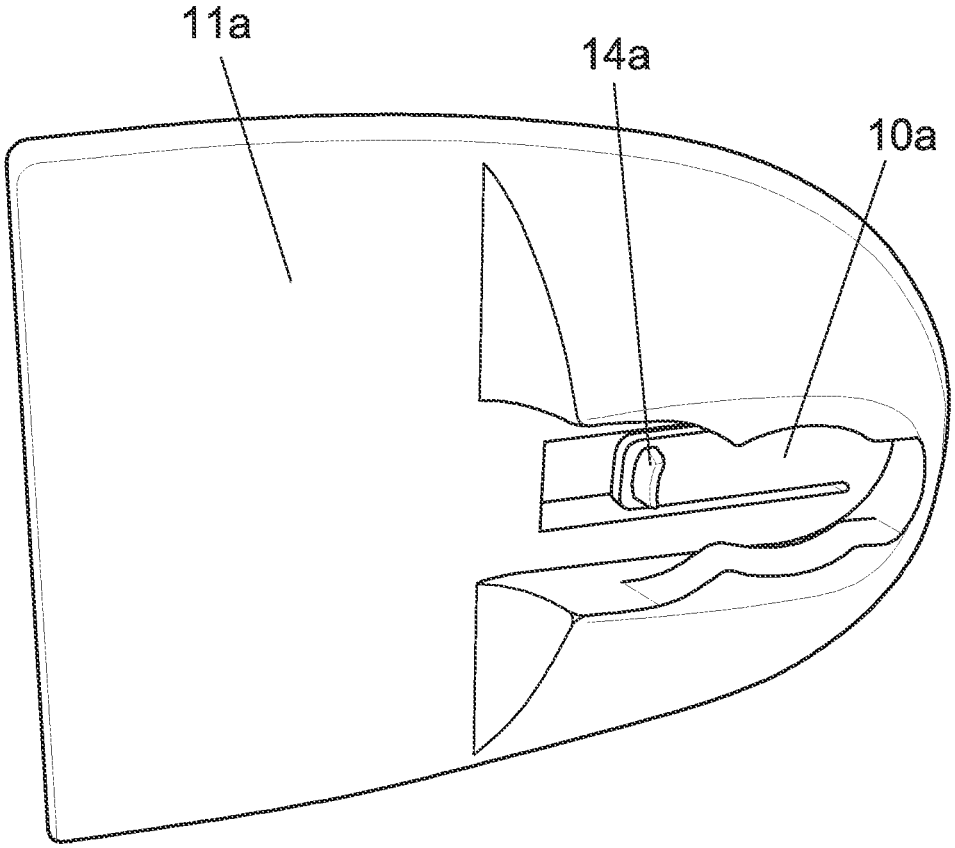
FIG. 7 shows a perspective view of the face of the second connection means intended to come into contact with the first connection means.

The buoyancy control jacket 1 substantially comprises an air chamber with a variable volume 2 and comprising an outer wall 2*a* and an inner wall 2*b* (see FIG. 4), with reference to the diver's body.

The air chamber has a substantially doughnut shape, and in the central part thereof 40, the jacket comprises means for attaching the cylinder, not illustrated in the figure.

Figure 1:
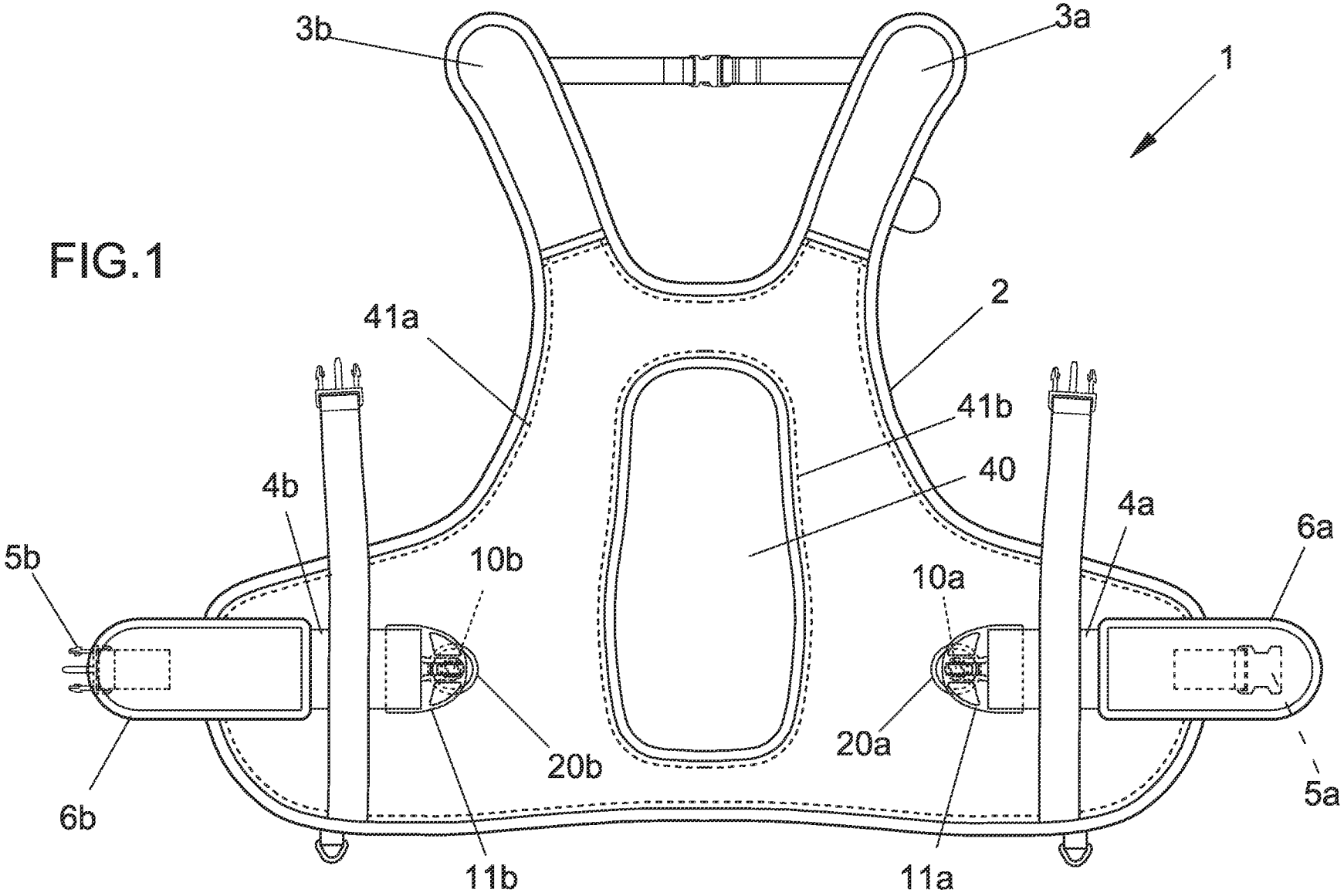
FIG. 1 shows an overall inside view of the buoyancy control jacket.
Figure 2:
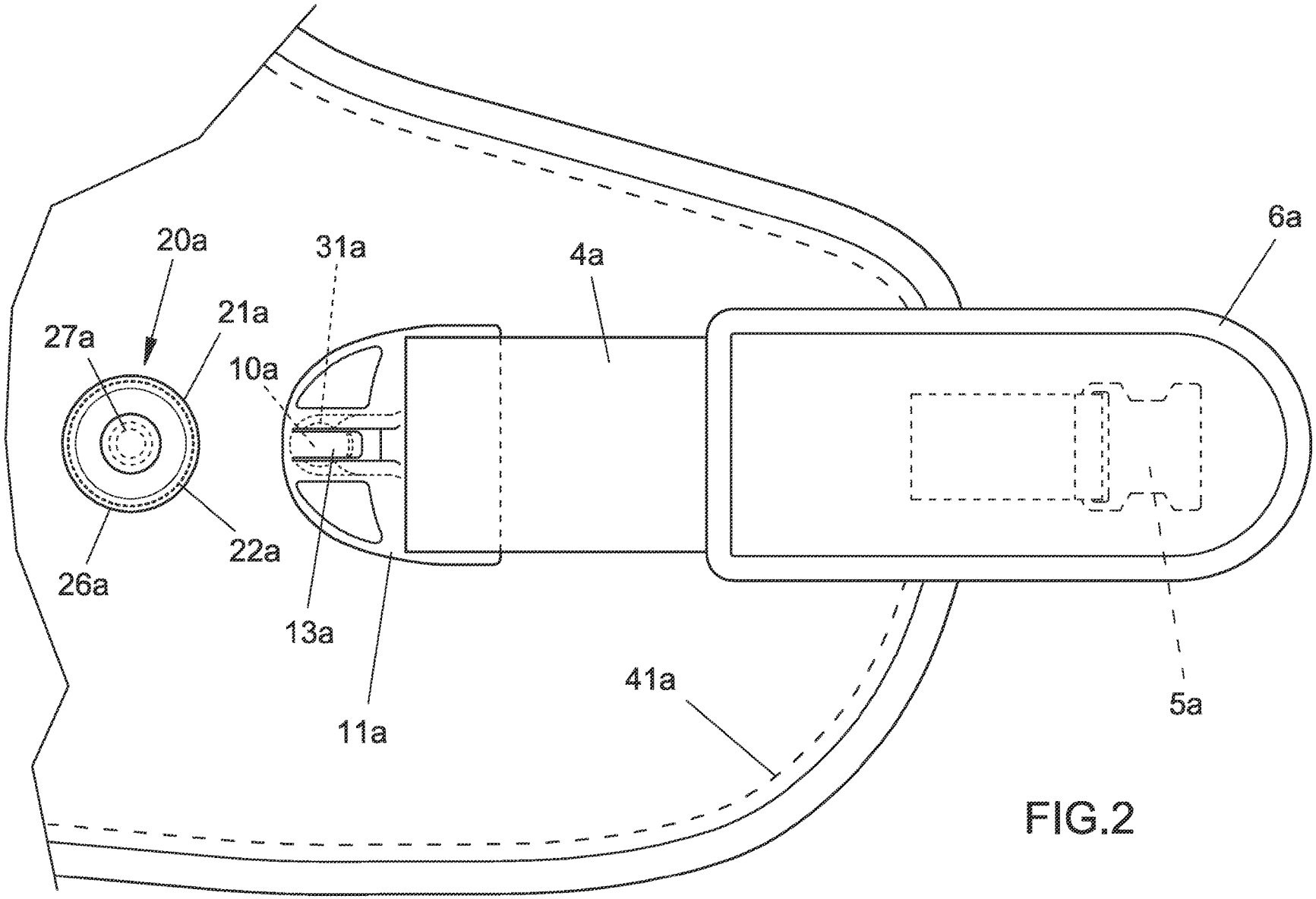
FIG. 2 shows a front view of an abdominal closing half-strap and of the first and second connection means (BCD not represented for the sake of image clarity), half-strap not coupled.
Figure 3:
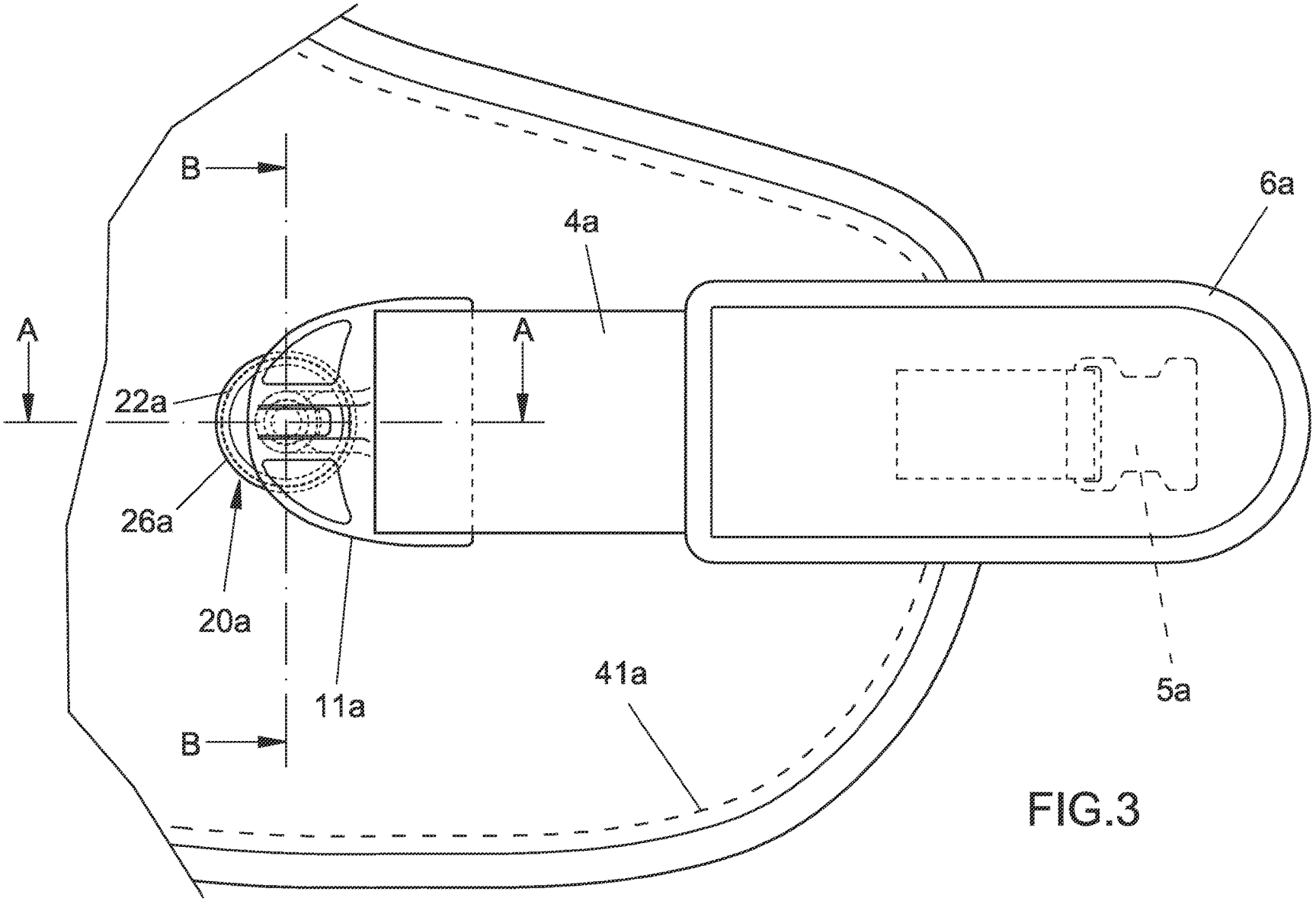
FIG. 3 shows a front view of an abdominal closing half-strap and of the first and second connection means (BCD not represented for the sake of image clarity), half-strap coupled.

In FIG. 1, the broken lines 41*a* and 41*b* highlight the perimeter seal of the air chamber.

The buoyancy control jacket 1 is fit tightly to the body by means of a strap, preferably formed by two abdominal half-straps 4*a* and 4*b* advantageously supported by the air chamber 2.

The buoyancy control jacket 1 is worn by the diver by means of shoulder straps 3*a* and 3*b* supported by the air chamber 2.

The support (not shown) for the compressed air cylinder is also supported by the air chamber, in particular on the outer delimiting wall 2*a*.

In this manner, there is no need to provide for a dedicated harness to support the components of the jacket 1, given that the air chamber 2 also acts as a support element for all the main elements making up the jacket 1.

The two abdominal half-straps 4*a*, 4*b* have first ends that are reciprocally engageable in a disengageable manner, for example, but not necessarily, with quick-connect means 5*a* and 5*b* and with the overlap of the Velcro strips 6*a* and 6*b*.

Advantageously, the jacket 1 has a removable association device between the inner wall 2*b* of the air chamber 2 and the abdominal strap 4*a*, 4*b*.

The association device comprises first connection means 20*a*, 20*b* and second connection means 11*a*, 11*b* respectively attached to the inner wall 2*b* of the air chamber 2 and to the abdominal strap 4*a*, 4*b*, a retaining means for retaining the second connection means 11*a*, 11*b* relative to the first connection means 20*a*, 20*b* along an axis L that is substantially orthogonal to the strap 4*a*, 4*b*, and a means of rotation about the axis L of the second connection means 11*a*, 11*b* relative to the first connection means 20*a*, 20*b*.

The second connection means 11*a*, 11*b* comprise, for each half-strap 4*a*, 4*b*, a terminal positioned at a second end of the half-straps 4*a*, 4*b*.

The first connection means 20*a*, 20*b* comprise, for each half-strap 4*a*, 4*b*, a pin 27*a*, 27*b* engageable in the corresponding terminal.

Below we will describe only the part of the association device pertinent to the half-strap 4*a*, given that the part of the association device pertinent to the half-strap 4*b* is identical.

The retaining means comprises, on the terminal, a sliding perimeter engagement groove 31*a* for the head 29*a* of the pin 27*a* and an elastic tab 13*a* with a free beaklike end 14*a* for retaining the head 29*a* of the pin 27*a* in the groove 31*a*.

The perimeter groove 31*a* and the elastic tab 13*a* thus delimit a snap coupling seat 10*a* for the head 29*a* of the pin 27*a*.

The rotation means comprises mating surfaces between the head 29*a* of the pin 27*a* and the snap coupling seat 10*a*.

The snap coupling seat 10*a* is therefore elastically disengageable from the head 29*a* of the pin 27*a* of a mating shape.

In greater detail, the head 29*a* of the shaped pin 27*a* engages slidingly, thanks to its mating shape, within the perimeter groove 31*a*, during the coupling of the half-strap 4*a*, until coming up against a limit stop 12*a*; along its sliding path within the perimeter groove 31*a* that leads to the snap coupling seat 10*a* the head 29*a* of the shaped pin 27*a* meets and elastically bends the elastic tab 13*a*.

On reaching the travel limit and coming up against the limit stop 12*a*, the head 29*a* of the shaped pin 27*a* is disengaged from the elastic tab 13*a*, which elastically returns into its initial position, engaging the head 29*a* of the shaped pin 27*a* by means of its free beaklike end 14*a*, thus securing the half-strap 4*a* onto the air chamber 2.

Advantageously, thanks to the pivoted connection about the axis L, it is possible to freely orient the half-strap 4*a* once connected to the air chamber 2.

A suitable through opening 15*a* in the terminal enables an easy manual elastic disengagement of the beak 14*a* from the head 29*a* of the shaped pin 27*a*, thus allowing the reverse sliding of the pin 27*a* in the perimeter groove 31*a* and therefore freeing the half-strap 4*a* from the coupling and from the air chamber 2.

The half-straps 4*a*, 4*b*, in addition to being freely orientable, can comprise an elastic zone, interposed between the first and second ends, in order to even better improve the versatility of use on divers of a different size.

Advantageously, the jacket comprises a reinforcement means for reinforcing the inner wall 2*b* of the air chamber 2 for the distribution of forces transmitted by the second connection means 11*a*, 11*b* to first connection means 20*a*, 20*b*.

Below we will describe only the part of the reinforcement means pertinent to the half-strap 4*a*, given that the part of the reinforcement means pertinent to the half-strap 4*b* is identical.

The reinforcement means thus comprises an anchorage base 21*a* anchoring to the outer face of the inner delimiting wall 2*b*.

More precisely, the pin 27*a* extends according to the axis L from the anchorage base 21*a*, in particular from the centre of the anchorage base 21*a*.

The shaped pin 27*a* has, between the head 29*a* and the anchorage base 21*a*, a recess 28*a* which enables the engagement of the head 29*a* along the perimeter groove 31*a*.

The pin 27*a* has, in particular, a cylindrical configuration with a discontinuity in diameter between the part defining the head 29*a* and the part defining the recess 28*a*.

The anchorage base 21*a* is formed, for example, by a flat rigid or semi-rigid plate.

The shaped pin 27*a* is preferably made in one piece with the anchorage base 21*a*.

The pin 27*a* and the anchorage base 21*a* are preferably made of plastic.

The anchorage base 21*a* is anchored to the outer face of the inner wall 2*b* of the air chamber 2 by means of through stitching 22*a*, positioned on a lowered perimeter plane 23*a* relative to the base 21*a*.

Inside the air chamber 2, a sealing element 25*a* circumscribing the through stitching 22*a* is coupled on the inner face of the inner wall 2*b*.

Advantageously, the zone of coupling between the sealing element 25*a* and the inside of the inner wall 2*b* continuously circumscribes the stitching 22*a*.

The sealing element 25*a* can have, as shown, larger dimensions than the anchorage base 21*a*.

In particular, in the case shown, the zone of coupling between the sealing element 25*a* and the inner face of the inner wall 2*b* is configured as a strip 26*a* closed on itself which continuously circumscribes the anchorage base 21*a*.

Given that the strip 26*a* sealing the sealing element 25*a* to the inner face of the inner delimiting wall 2*b* circumscribes the stitching 22*a*, the mechanical stresses transmitted by the half-strap 4*a*, 4*b* to the air chamber 2 are not propagated to the sealing line, which will thus not deteriorate over time.

Alternatively, it is possible to provide for a zone of coupling between the sealing element 25*a* and the inner face of the inner wall 2*b* configured as a strip closed on itself positioned between the stitching 22*a* and the perimeter edge 30*a* of the base 21*a*.

The outer wall 2*a* and inner wall 2*b* of the air chamber 2 and the sealing element 25*a* are flexible elements arranged in layers, in particular but not necessarily made of thermoplastic materials.

For example, the material used to make the air chamber 2 of the buoyancy control jacket 1 can be a thermoplastic Cordura nylon fabric spread internally with PU to ensure the airtightness thereof; in such a case the sealing element 25*a* is likewise made of a thermoplastic fabric, so that the sealing of the sealing element 25*a* on the inside of the inner wall 2*b* takes place by high-frequency ultrasonic bonding.

Typically, the shape of the enlarged base 21*a* can be circular; the sealing element 25*a* as well can thus typically have a circular shape, with a diameter larger than that of the enlarged base 21*a*; a high-frequency ultrasonic bonding takes place between the sealing element 25*a* and the inside of the inner wall 2*b*, thus defining a circular crown that surrounds the enlarged base 21*a*.

The functioning of the buoyancy control jacket for scuba diving according to the invention appears evident from what has been described and illustrated and, in particular, is substantially the following.

In the case of a first application or replacement of a semi abdominal strap 4*a* on the buoyancy control jacket 1, the user brings the end of the half-strap 4*a* that has the snap coupling seat 10*a* near the head of the shaped pin 27*a*, making it slide in the groove 31*a* of mating shape until it comes up against the limit stop 12*a*, where the elastic tab 13*a* locks it by means of its beaklike end 14*a*.

To remove the semi abdominal strap 4*a* from the buoyancy control jacket 1, the user acts manually through the appropriate opening 15*a* until elastically disengaging the beak 14*a* from the head of the shaped pin 27*a*, thereby enabling the reverse sliding of the shaped pin 27*a* and thus freeing the half-strap 4*a* from the coupling and from the air chamber 2.

It has in practice been found that a buoyancy control jacket according to the invention is particularly advantageous because of the closure achieved with an abdominal strap consisting of two removable half-straps, which are reliable and easily removable in total safety, by means of elastically disengageable mechanical fastening means.

The buoyancy control jacket thus conceived is susceptible of numerous modifications and variants, all falling within in the scope of the inventive concept; moreover, all the details may be replaced with technically equivalent elements.

The materials used, as well as the dimensions, may in practice be any whatsoever, according to needs and the state of the art.

The invention claimed is:

1. A buoyancy control jacket (1) for scuba diving comprising:

at least one air chamber (2) with an adjustable volume delimited by an outer wall (2*a*) and an inner wall (2*b*), at least one abdominal closing strap (4*a*, 4*b*), a removable association device associated with each abdominal closing strap (4*a*, 4*b*), wherein each removable association device is located between said inner wall (2*b*) and said respective abdominal closing strap (4*a*, 4*b*), wherein each said removable association device comprises:

a first (20*a*, 20*b*) and a second (11*a*, 11*b*) connector respectively attached to said inner wall (2*b*) and to said abdominal closing strap (4*a*, 4*b*), wherein said first (20*a*, 20*b*) connector comprises a pin (27*a*), and said second (11*a*, 11*b*) connector comprises a corresponding engagement terminal, a retainer configured to releasably secure said second connector (11*a*, 11*b*) relative to said first connector (20*a*, 20*b*) along an axis (L) that is substantially orthogonal to said abdominal closing strap (4*a*, 4*b*), wherein, while being releasably secured, said second connector (11*a*, 11*b*) is rotatable relative to said first connector (20*a*, 20*b*) about said axis (L), and a reinforcement system for each removable association device that reinforces at least said inner wall (2*b*) from the distribution of forces transmitted by said second (11*a*, 11*b*) connector to said first (20*a*, 20*b*) connector, the reinforcemet system comprising:

an anchorage base (21*a*) of said first (20*a*, 20*b*) connector, from which said pin (27*a*) extends, anchored to at least said inner wall (2*b*), where said anchorage base (21*a*) has perimeter through stitching (22*a*) joining to said inner wall (2*b*).

2. The buoyancy control jacket (1) for scuba diving according to claim 1, wherein two abdominal closing straps (4*a*, 4*b*) are provided, the two abdominal closing straps (4*a*, 4*b*) comprise two half-straps (4*a*, 4*b*) having first ends that are reciprocally engageable in a disengageable manner, and second ends having said second connectors (11*a*, 11*b*).

3. The buoyancy control jacket (1) for scuba diving according to claim 1, wherein said retainer comprises, on said engagement terminal, a sliding perimeter engagement groove (31*a*) for a head (29*a*) of said pin (27*a*) and an elastic tab (13*a*) with a free beaklike end (14*a*) for retaining said head (29*a*) of said pin (27*a*) in said groove (31*a*).

4. The buoyancy control jacket (1) for scuba diving according to claim 3, wherein, while being releasably secured, said second connector (11*a*, 11*b*) is rotatable relative to said first connector (20*a*, 20*b*) by a mating surface between said head (29*a*) of said pin (27*a*) and a snap coupling seat (10*a*).

5. The buoyancy control jacket (1) for scuba diving according to claim 1, wherein said abdominal closing strap (4*a*, 4*b*) comprises at least one elastic zone.

6. The buoyancy control jacket (1) for scuba diving according to claim 1, wherein, inside said air chamber (2), there is provided a sealing element (25*a*) of said stitching (22*a*) circumscribing said stitching (22*a*).

7. The buoyancy control jacket (1) for scuba diving according to claim 6, further comprising a line of welding of said sealing element (25*a*) to said inner wall (2*b*) circumscribing said stitching (22*a*).

8. The buoyancy control jacket for scuba diving (1) according to claim 6, wherein said sealing element (25*a*) circumscribes said anchorage base (21*a*).

9. The buoyancy control jacket for scuba diving (1) according to claim 1, wherein said anchorage base (21*a*) has a lowered perimeter surface (23*a*) along which said through stitching (22*a*) extends.

10. The buoyancy control jacket for scuba diving (1) according to claim 1, wherein said air chamber supports shoulder straps and a support for positioning a cylinder of compressed air.

11. The buoyancy control jacket (1) for scuba diving according to claim 1, wherein, along an inner surface of said inner wall (2*b*), there is provided a backing element of said stitching (22*a*) circumscribing said stitching (22*a*), the backing element being of a material similar to said inner wall (2*b*).

12. The buoyancy control jacket (1) for scuba diving according to claim 11, further comprising a line of welding of said backing element to said inner wall (2*b*) circumscribing said stitching (22*a*).

13. The buoyancy control jacket (1) for scuba diving according to claim 12, wherein the backing element comprises a portion of said outer wall (2*a*).

* * * * *